US006659798B2

(12) United States Patent
Mase et al.

(10) Patent No.: US 6,659,798 B2
(45) Date of Patent: Dec. 9, 2003

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/178,307

(22) Filed: Jun. 21, 2002

(65) Prior Publication Data

US 2002/0197913 A1 Dec. 26, 2002

(30) Foreign Application Priority Data

Jun. 22, 2001 (JP) ..... 2001-190202
Jun. 25, 2001 (JP) ..... 2001-191292

(51) Int. Cl.[7] ..... H01R 13/422
(52) U.S. Cl. ..... 439/595; 439/752
(58) Field of Search ..... 439/595, 752

(56) References Cited

U.S. PATENT DOCUMENTS 6,071,153 A * 6/2000 Fink et al. ..... 439/752
6,186,813 B1 * 2/2001 Tomita et al. ..... 439/271
6,193,551 B1 * 2/2001 Yamamoto et al. ..... 439/595
6,296,531 B1 * 10/2001 Nagamine ..... 439/752

FOREIGN PATENT DOCUMENTS

JP 61-90174 6/1986

* cited by examiner

*Primary Examiner*—Gary Paumen
*Assistant Examiner*—James R. Harvey
(74) *Attorney, Agent, or Firm*—Anthony J. Casella; Gerald E. Haspos

(57) ABSTRACT

A retainer (40) has first securing portions (48) for securing terminal fittings (30) by entering deformation-permitting spaces (17) to prevent the resilient deformation of locks (13) and second securing portions (50) for securing the terminal fittings (30) by directly engaging the terminal fittings (30). Thus, even if one of the first securing portions (48) and the second securing portions (50) are narrowed to make a connector smaller, the terminal fittings (30) can be locked securely by the other securing portions and an insufficient insertion can be detected.

13 Claims, 16 Drawing Sheets

CONNECTOR

BACKGROUND OF THE INVENTION

1. Field of the Invention

The invention relates to a connector with a retainer for one or more locking terminal fittings.

2. Description of the Related Art

Japanese Unexamined Utility Model Publication No. 61-90174 discloses a connector with a housing that has insertion spaces for receiving terminal fittings. Resiliently deformable locks are formed in the housing adjacent the insertion spaces, and deformation-permitting spaces are formed in the housing on the side of the locks opposite the insertion spaces. The locks deform into the deformation-permitting spaces and retract from the insertion spaces during the insertion of the terminal fittings. However, the locks are restored resiliently to engage and lock the terminal fittings when the terminal fittings are inserted properly.

A retainer is assembled with the housing after the terminal fittings are inserted and deformation-preventing portions of the retainer are inserted into the deformation-permitting spaces. The deformation-preventing portions prevent the locks from being resiliently deformed away from the terminal fittings and toward the deformation-permitting spaces. As a result, the terminal fittings are locked doubly.

The lock remains in the deformation-permitting space if a terminal fitting is inserted insufficiently. Thus, the lock interferes with the deformation-preventing portion and prevents the deformation-preventing portion from entering the deformation-permitting space, if an attempt is made to assemble the retainer with the housing. As a result, the lock hinders assembly of the retainer with the housing, and the inserted states of the terminal fittings can be detected based on whether the retainer can be assembled with the housing.

The terminal fittings of the prior art connector are locked doubly by the direct engagement of the locks and by the insertion of the deformation-preventing portion into the deformation-permitting spaces for the locks. The deformation-preventing portion could be thinned to make the connector smaller. However, the height of the deformation-permitting spaces and a degree of deformation of the locks would be reduced. The engaging areas of the locks with the terminal fittings also would be reduced, thereby reducing the reliability of the securing function. Further, the thin deformation-preventing portion would be weaker and would be easy to break. As a result, the function of detecting the insufficient insertion of the terminal fittings may be impaired.

The present invention was developed in view of the above problems and an object thereof is to improve the reliability of a function of securing terminal fittings and an insufficient insertion detecting function by a retainer.

SUMMARY OF THE INVENTION

The invention is directed to a connector with a housing that has at least one insertion path for receiving a terminal fitting, at least one lock adjacent the insertion path and at least one deformation-permitting space for the lock. At least one terminal fitting is inserted into the housing along the insertion path. The connector also has a retainer that can be assembled with the housing. The lock is deformed into the deformation permitting space and is retracted from the insertion path during the insertion of the terminal fitting. The lock is restored resiliently when the terminal fitting reaches its proper insertion position and the restored lock engages the terminal fitting to prevent the terminal fitting from coming out. The retainer comprises a first securing portion for securing the terminal fitting by entering the deformation-permitting space to prevent the resilient deformation of the lock and a second securing portion for directly engaging and securing the terminal fitting.

When the terminal fitting is inserted properly, the first securing portion enters the deformation-permitting space to prevent the lock from being deformed away from the terminal fitting, and the second securing portion directly engages the terminal fitting without the interposition of any member. Thus, the terminal fitting is secured firmly by the two securing portions.

When the terminal fitting is inserted insufficiently, the first securing portion interferes with the lock in the deformation permitting space and the second securing portion interferes with the terminal fitting. This hinders assembly of the retainer with the housing and detects insufficient insertion.

The retainer has the first and second securing portions. Thus, even if one of the securing portions is narrowed to make the connector smaller, the terminal fitting can be locked securely and the other securing portion can detect the insufficient insertion.

The terminal fittings may be arranged substantially side by side. Additionally, each terminal fitting, the corresponding lock and the corresponding deformation-permitting space are arranged at an angle to the arranging direction of the terminal fittings. Thus, there is no possibility of reducing the locking function of the first securing portions and the insufficient insertion detecting function due to the reduced arrangement intervals of the terminal fittings.

An assembling direction of the retainer with the housing preferably is substantially parallel with the arranging direction of the plurality of terminal fittings. Additionally, the terminal fittings can be arrayed at stages, and a plurality of terminal fittings can be arranged side by side at each stage.

The retainer may be movable between partial and full locking positions. The first securing portion is retracted from the deformation permitting space and the second securing portion is retracted from the insertion path when the retainer is in the partial locking position. Thus, the terminal fitting may be inserted into the housing when the retainer is in the partial locking position. However, the first securing portion enters the deformation permitting space and the second securing portion engages the inserted terminal fitting when the retainer is in the full locking position. Thus, the terminal fitting is held in the housing when the retainer is in the full locking position.

The retainer can be assembled at the partial locking position with respect to the housing when the housing and the retainer are shipped to a location where the terminal fittings are inserted. Thus, parts management at the time of shipment can be simplified.

The retainer preferably is formed integrally or unitarily with the second securing portion and an insertion-stop for holding the terminal fitting at an insertion-limit position by engaging the terminal fitting from a side opposite the second securing portion. Thus, a distance between the insertion-stop and the securing portion does not vary even if the retainer shakes with respect to the housing. This prevents the terminal fitting from making loose movements in inserting and withdrawing directions with respect to the housing.

The terminal fitting may be inserted into the housing from behind, and the insertion-stop may be a front-stop that the terminal fitting contacts from behind.

The insertion-stop preferably is held substantially in sliding contact when the retainer is moved along an assembling direction.

At least one of the second securing portion of the retainer and an engaging portion of the terminal fitting may have a slanted guide surface that extends oblique to an assembling direction of the retainer. Thus, if the terminal fitting is displaced from a proper insertion position during the movement of the retainer, the terminal fitting is pushed toward the proper insertion position by the inclination of the slanted guide surface.

At least one the deformation-preventing portion or the lock has slanted guides extending oblique to resiliently deforming directions of the locks and moving directions of the retainer between the first and second positions.

DETAILED DESCRIPTION OF THE PREFERRED EMBODIMENTS

Figure 1:
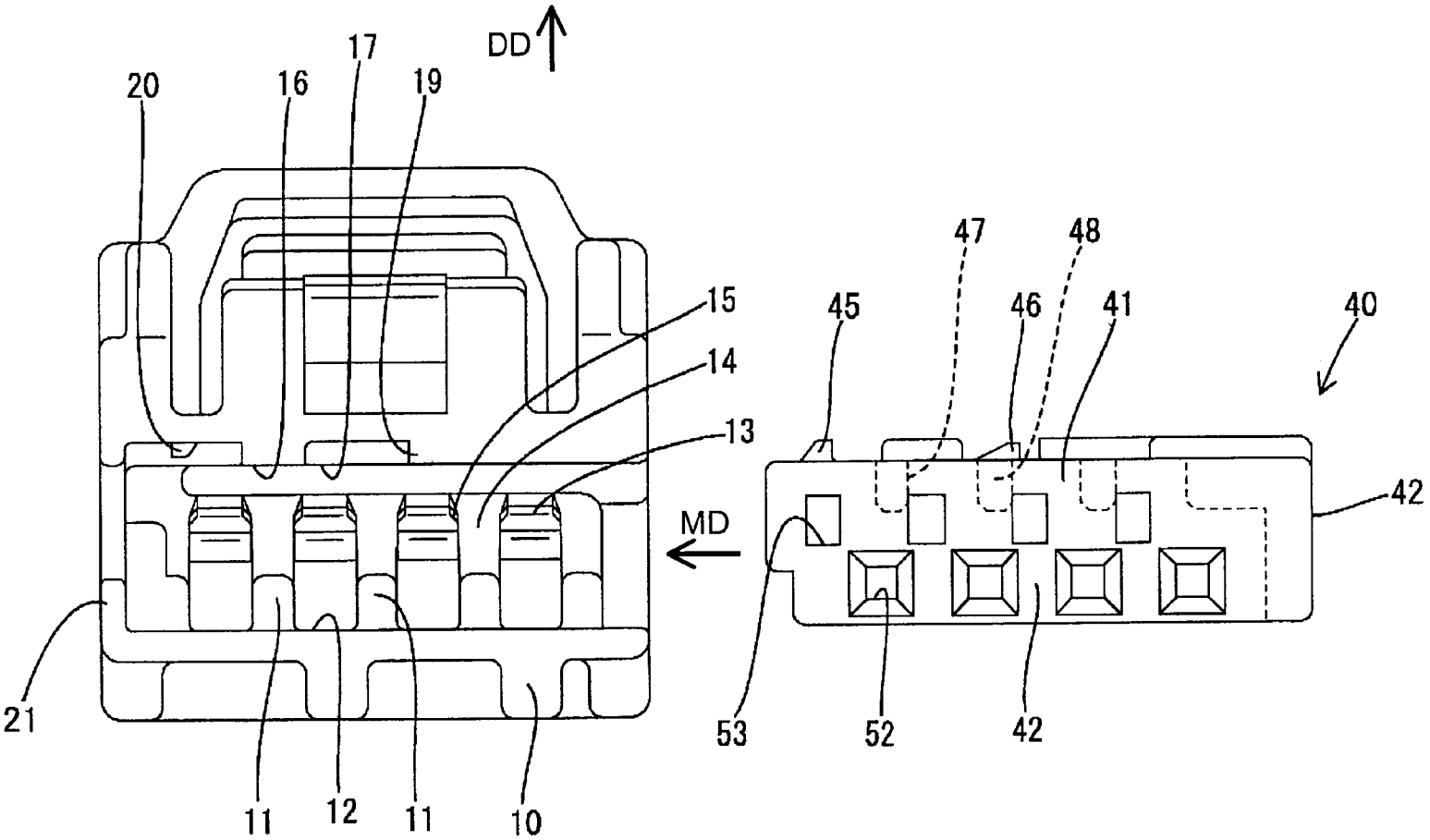
FIG. 1 is a front view showing a state where a retainer is detached from a housing in one embodiment of the present invention.
Figure 2:
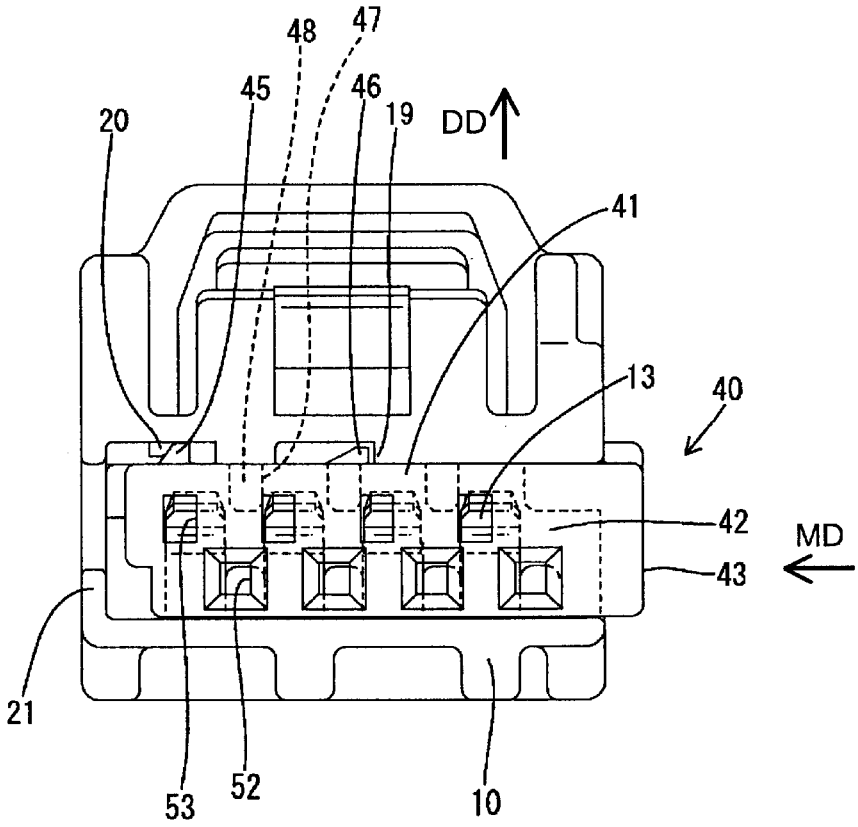
FIG. 2 is a front view showing a state where the retainer is mounted at a partial locking position in the housing.
Figure 3:
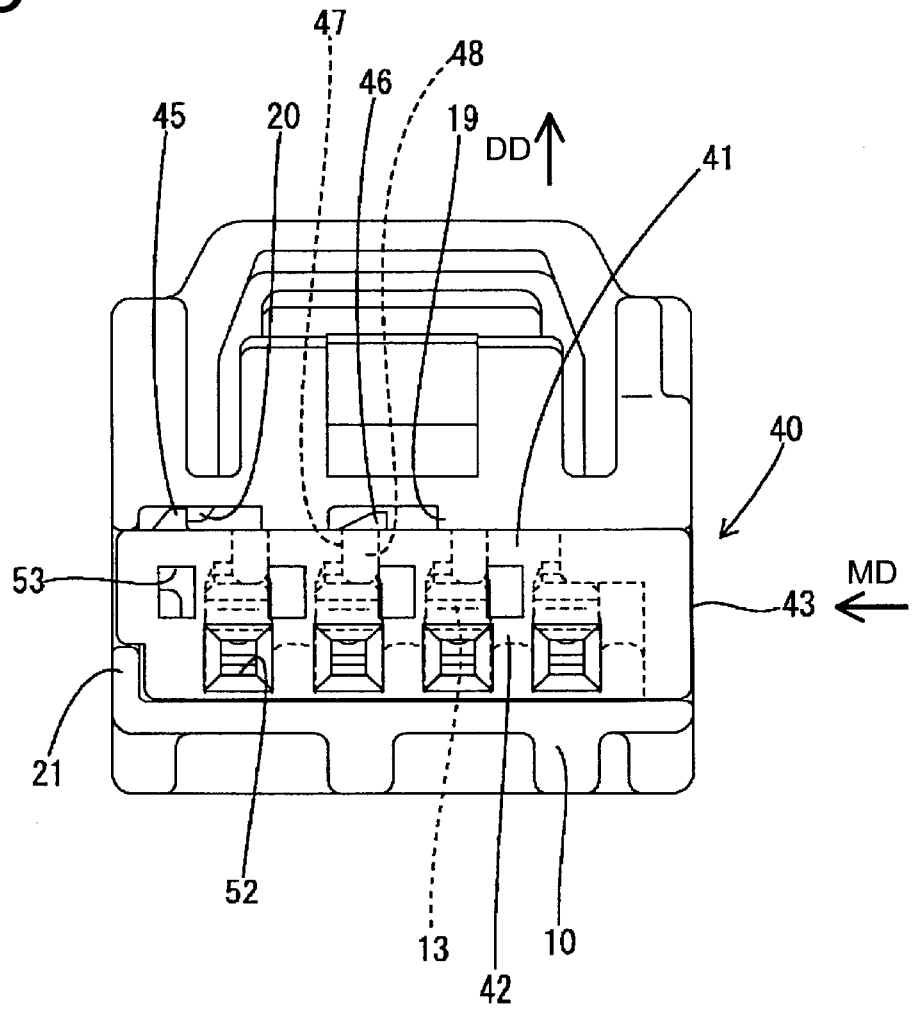
FIG. 3 is a front view showing the retainer at a full locking position.
Figure 4:
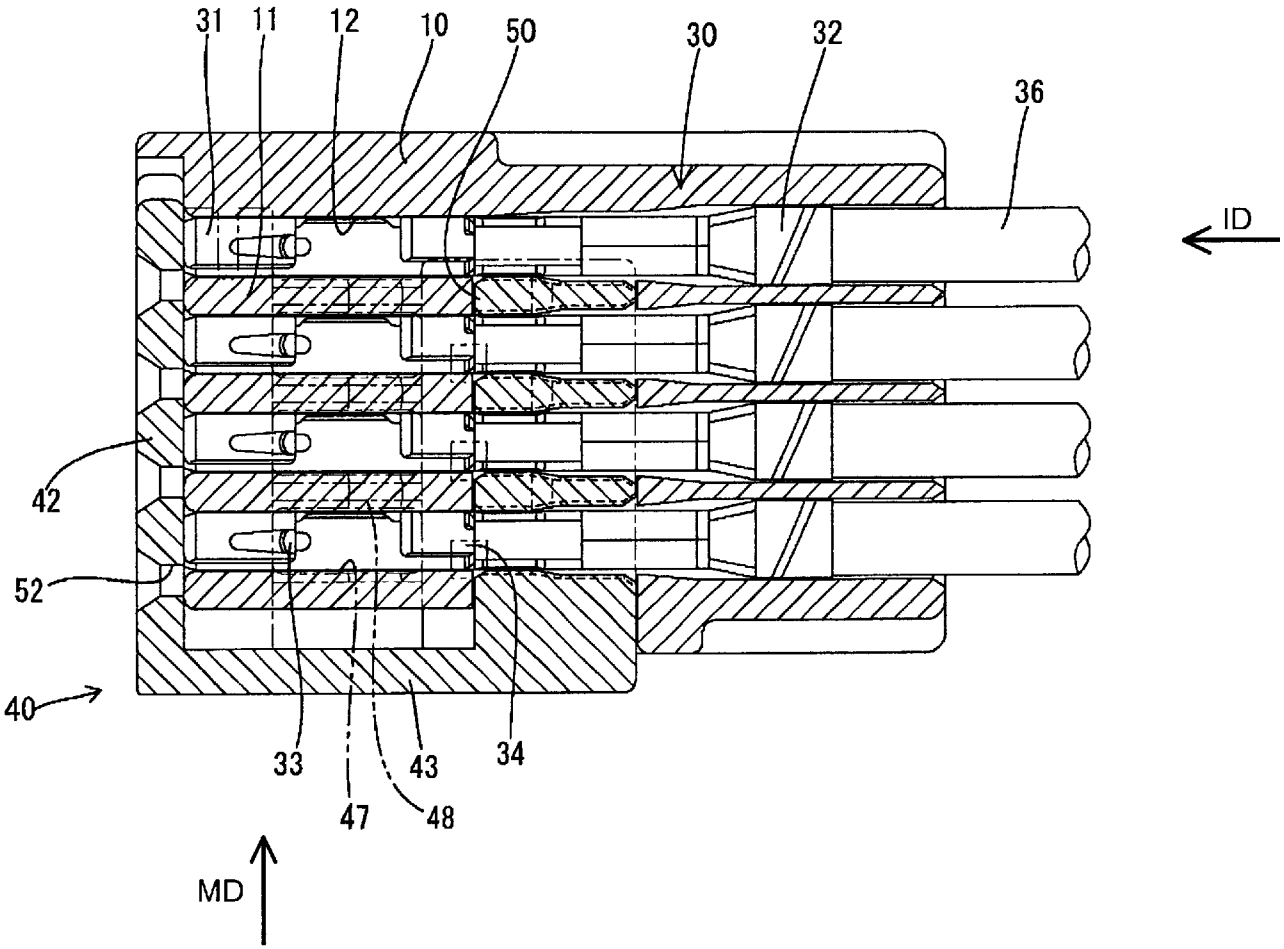
FIG. 4 is a horizontal section showing the retainer at the partial locking position in the housing.
Figure 5:
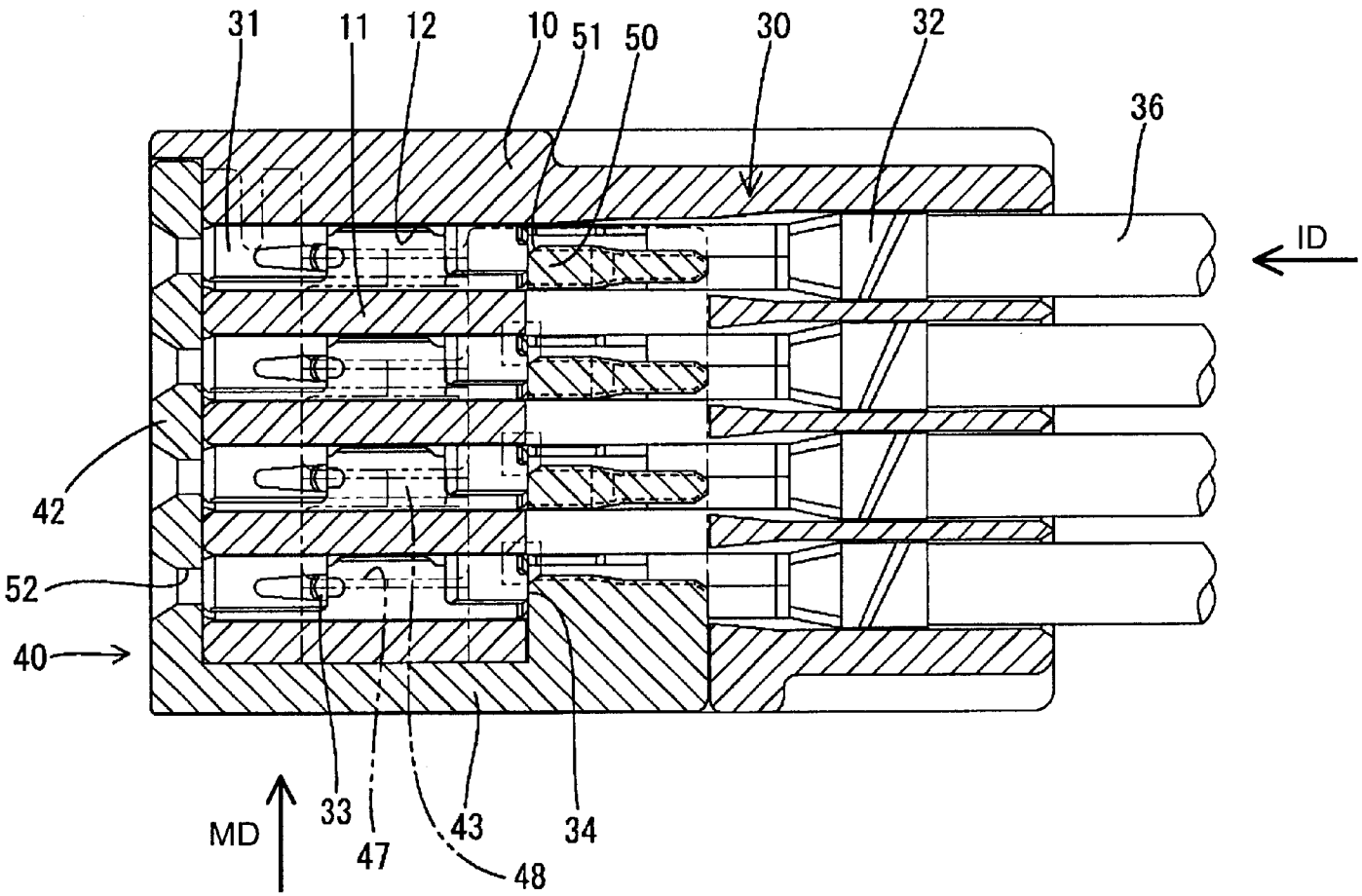
FIG. 5 is a horizontal section showing the retainer at the full locking position in the housing.
Figure 6:
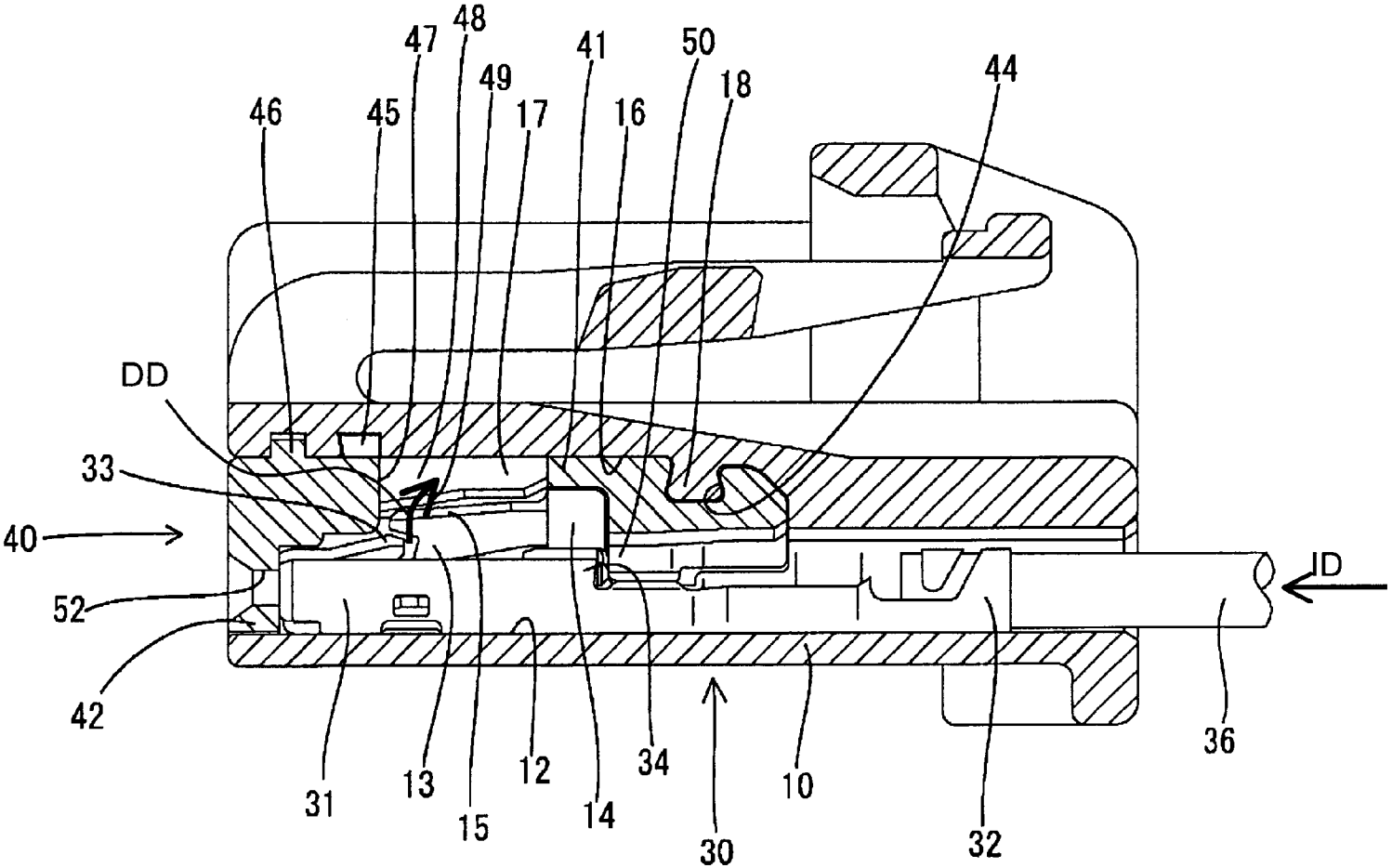
FIG. 6 is a vertical section showing a terminal fitting properly inserted in the housing.
Figure 7:
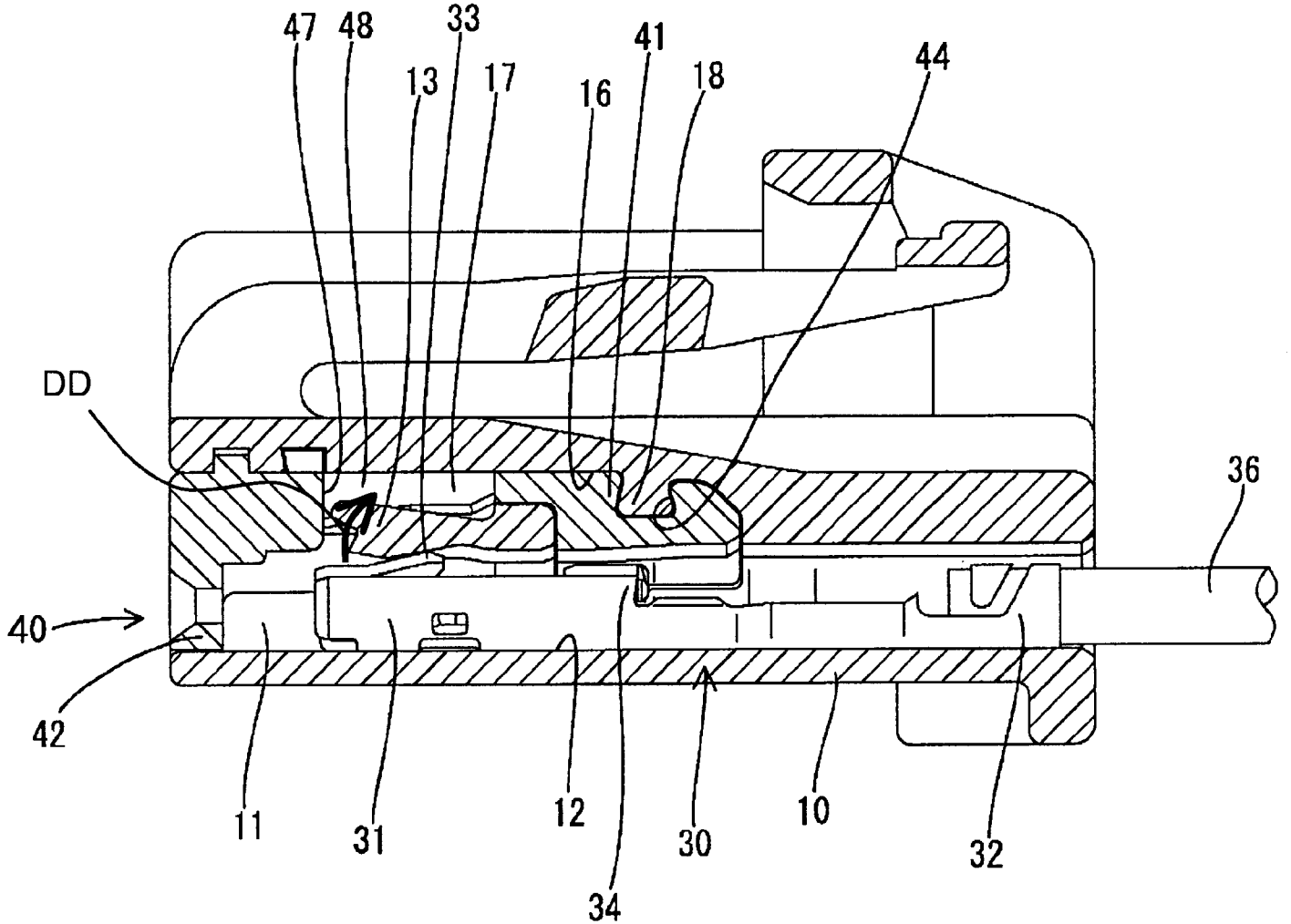
FIG. 7 is a vertical section showing an intermediate stage of insertion of the terminal fitting.
Figure 8:
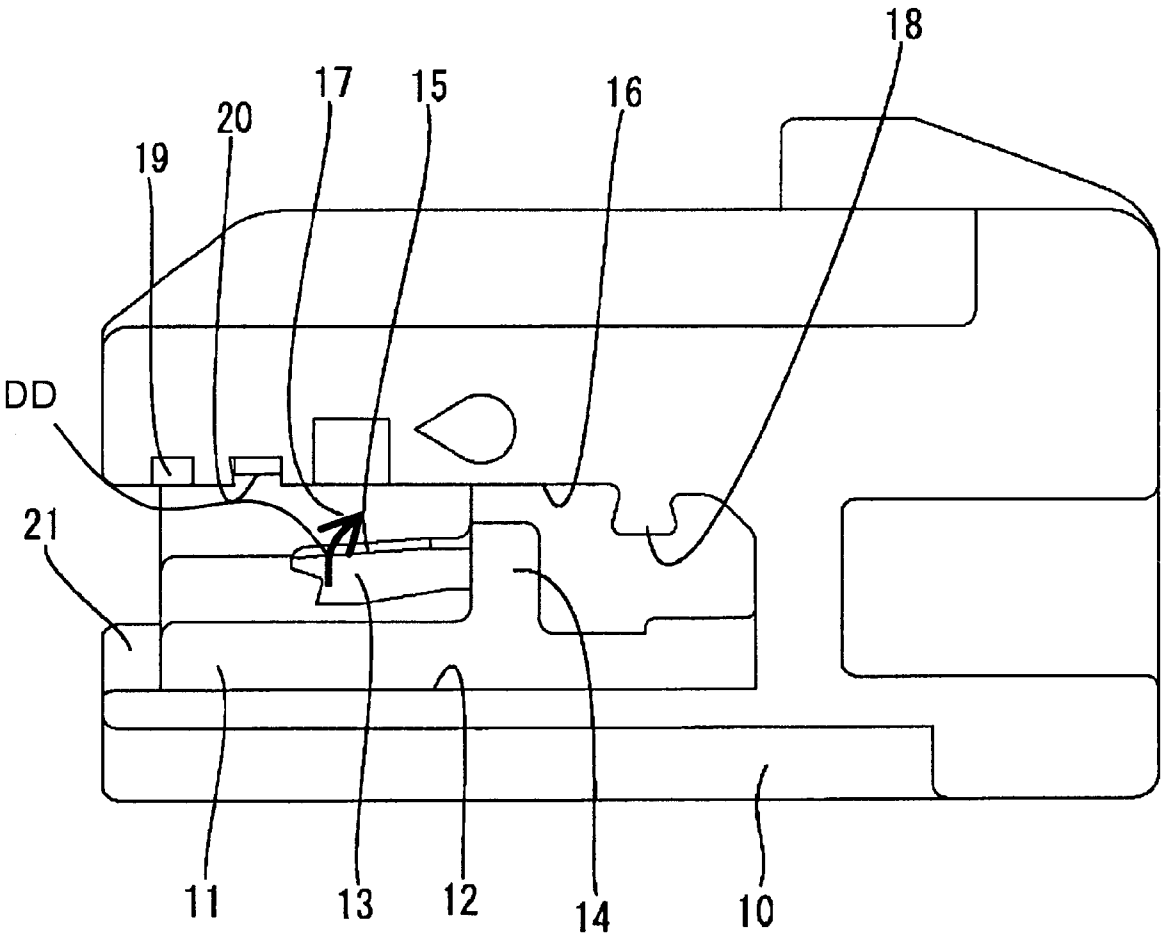
FIG. 8 is a side view of the housing.
Figure 9:
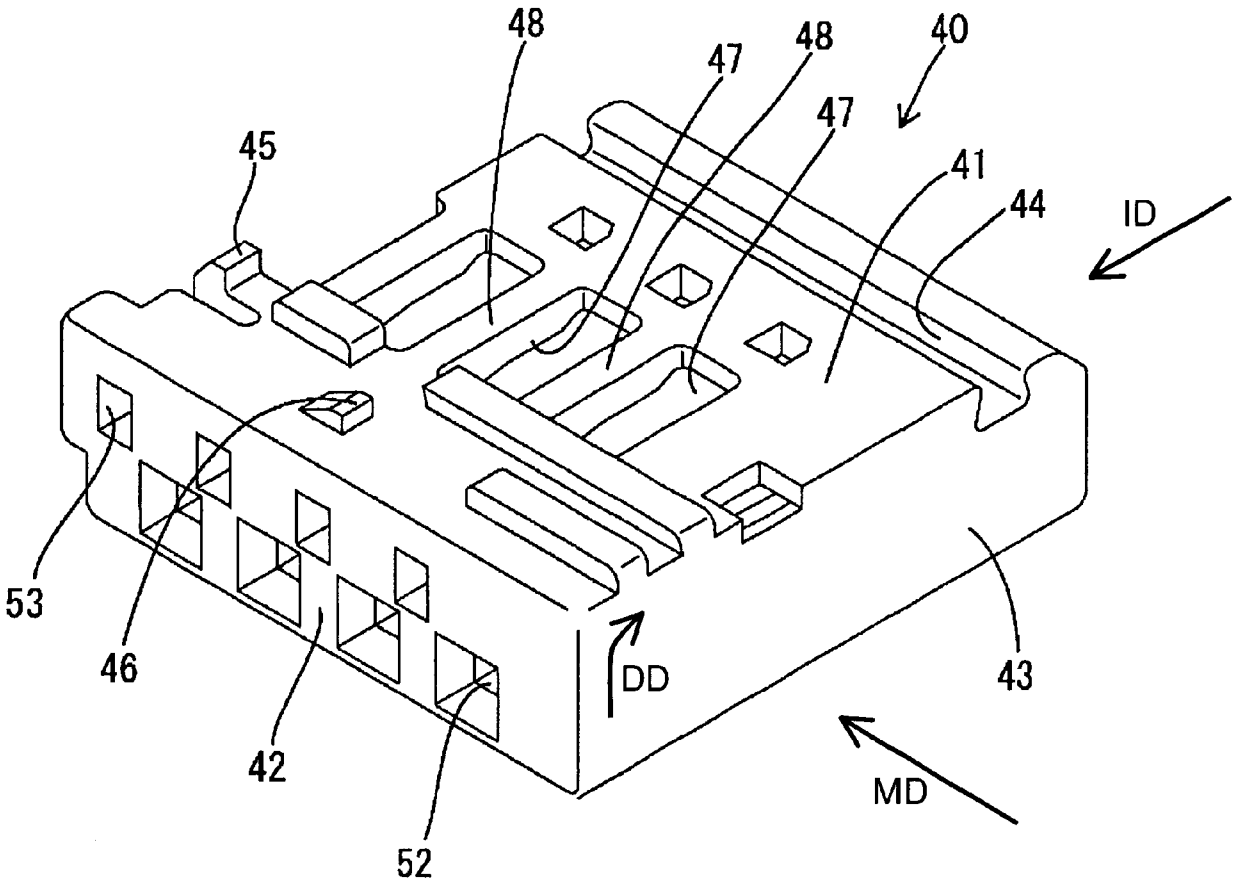
FIG. 9 is a perspective view of the retainer.
Figure 10:
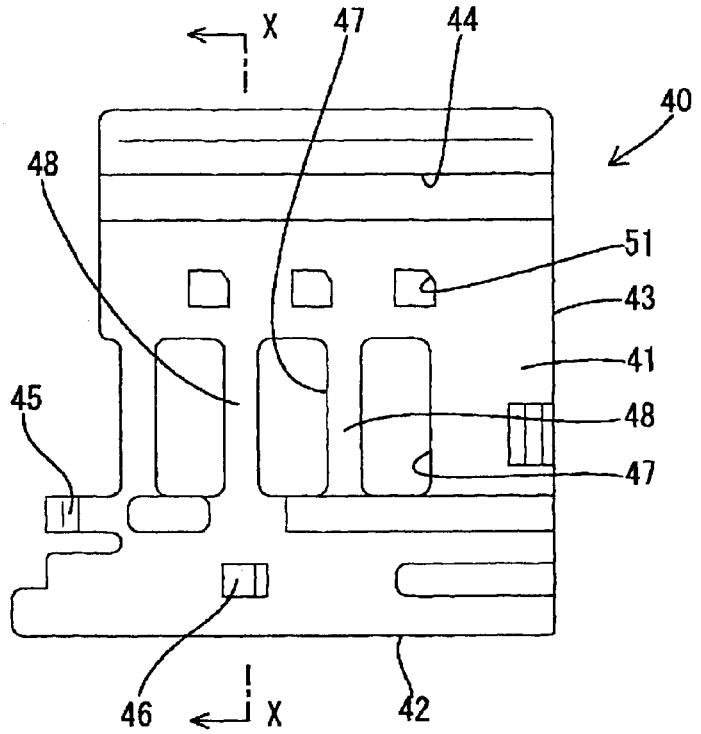
FIG. 10 is a plan view of the retainer.
Figure 11:
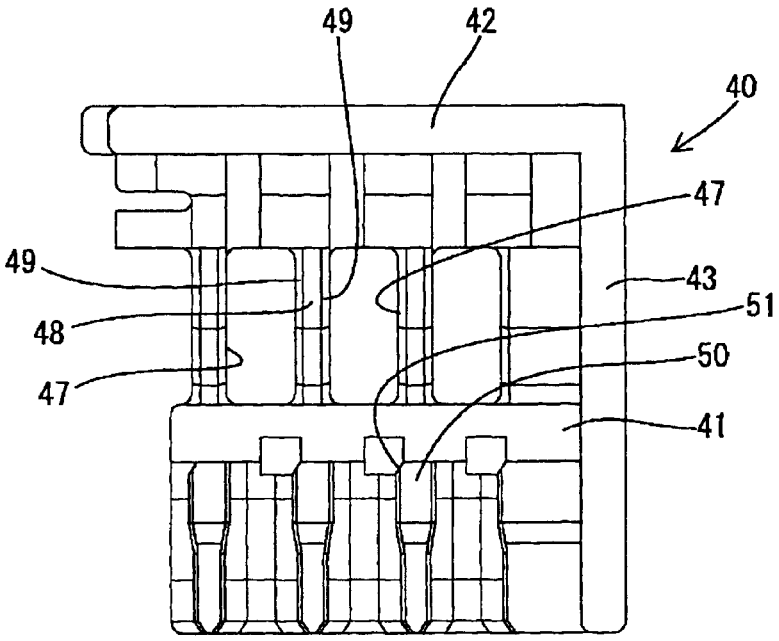
FIG. 11 is a bottom view of the retainer.
Figure 12:
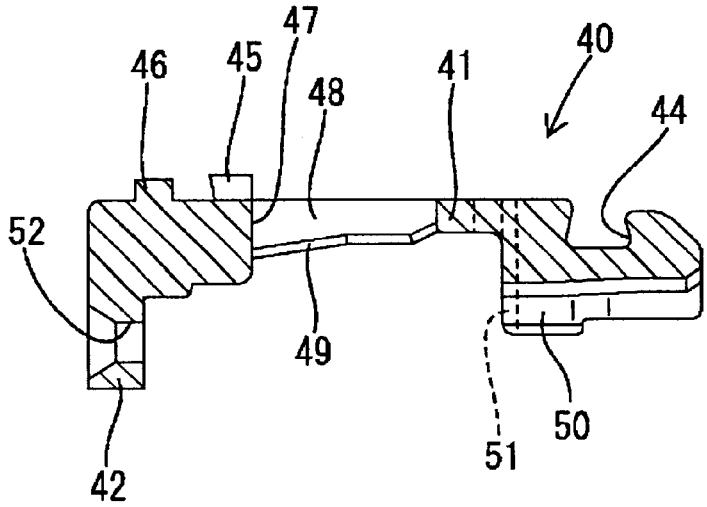
FIG. 12 is a section along 12—12 of FIG. 10.
Figure 13:
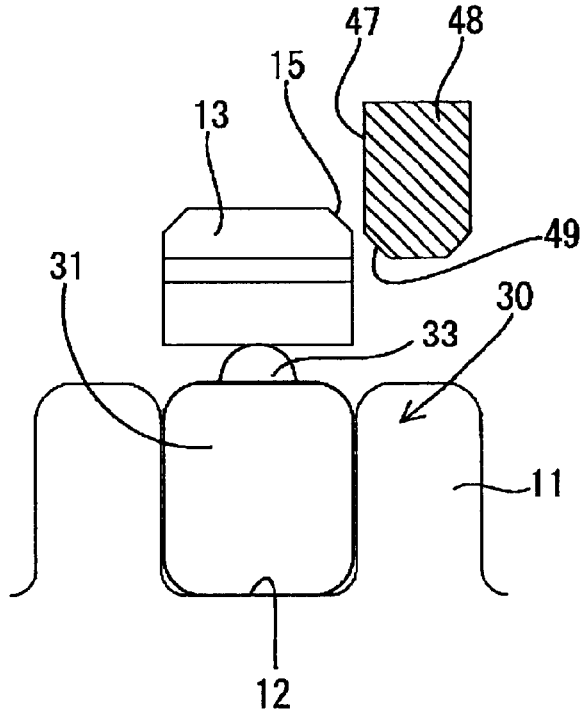
FIG. 13 is a horizontal section showing a positional relationship between the lock and the first securing portion at the intermediate stage of insertion of the terminal fitting.
Figure 14:
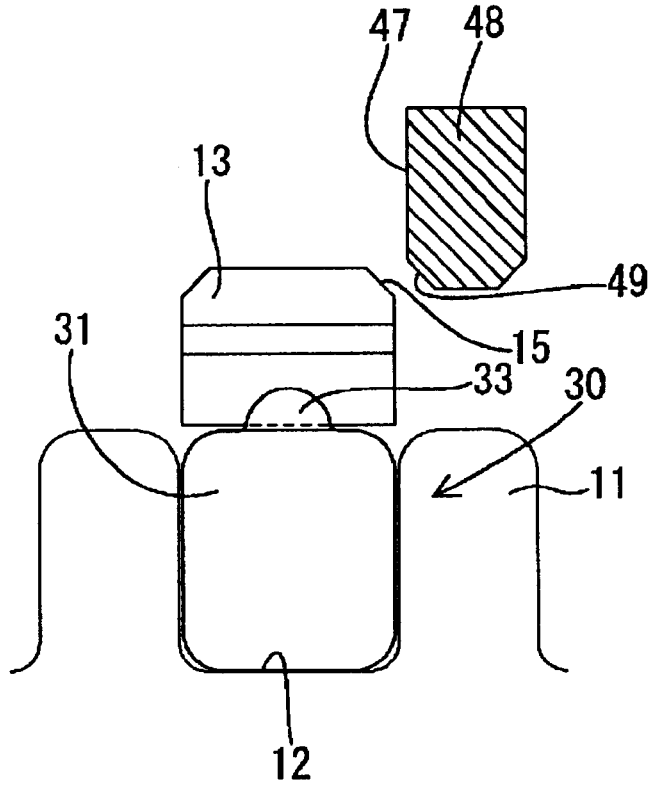
FIG. 14 is a horizontal section showing a positional relationship between the lock and the first securing portion in a state where the locking portion is engaged with the properly inserted terminal fitting.
Figure 15:
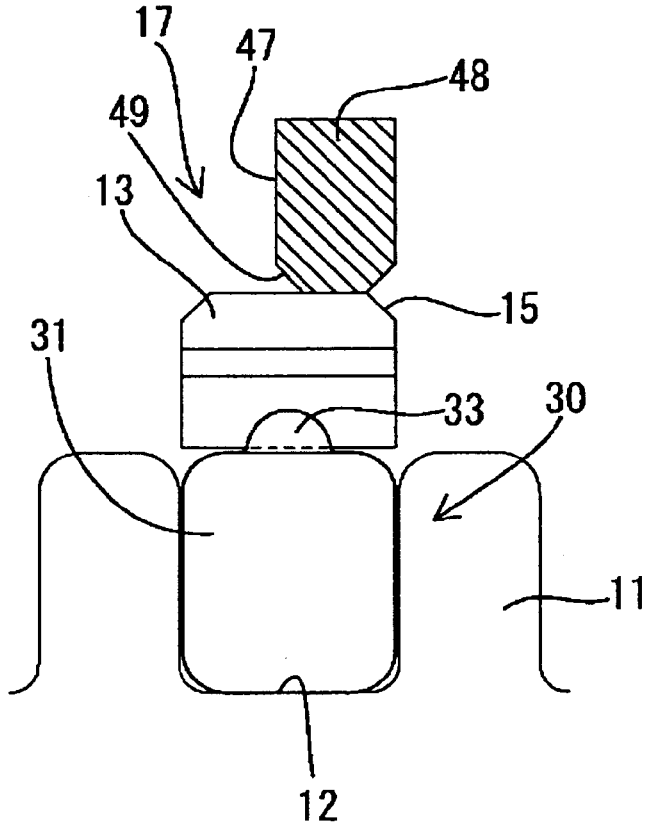
FIG. 15 is a horizontal section showing a positional relationship between the lock and the first securing portion in a state where the first securing portion prevents the resilient deformation of the lock.
Figure 16:
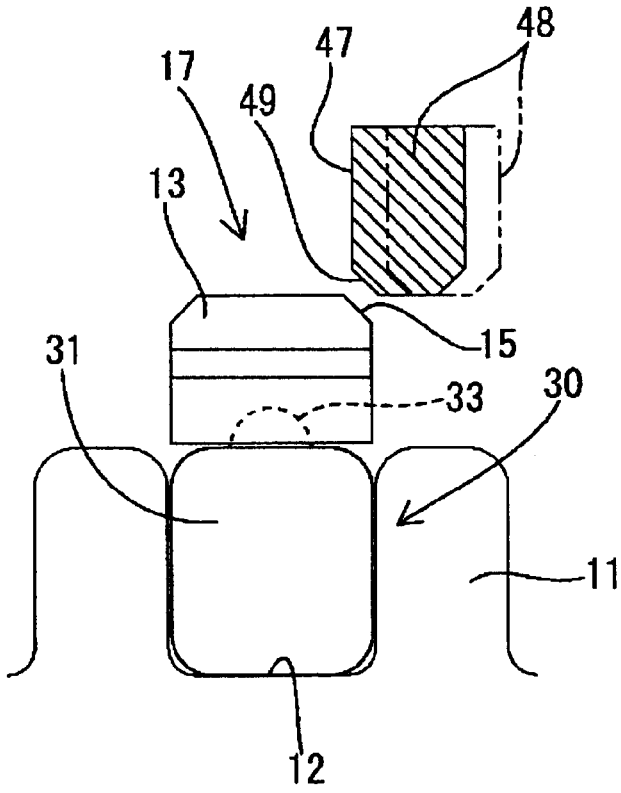
FIG. 16 is a horizontal section showing a positional relationship between the lock and the first securing portion in a state where the retainer is displaced toward the full locking position from the partial locking position.

A connector according to the invention includes a housing 10 made e.g. of a synthetic resin, terminal fittings 30, and a retainer 40 made e.g. of a synthetic resin, as shown in FIGS. 1 to 22. In the following description, the left side in FIGS. 4 to 8 is referred to as the front side, the bottom side in FIGS. 4 and 5 is referred to as the left side, and reference is made to FIGS. 1 to 3, 6 and 7 concerning vertical direction.

The housing 10 has partition walls 11 that define side-by-side cavities 12, and a lock 13 is formed in each cavity 12. Each lock 13 projects forward from a bridge 14 that stands up from the bottom surface of each cavity 12 and extends between the upper ends of the partition walls 11. Each lock 13 is supported at one end, and is resiliently deformable along the vertical direction. A slanted guide surface 15 is on the left end of the upper surface of each lock 13 (see FIGS. 1 and 13 to 18) and extends oblique to moving directions MD of the retainer 40 between partial and full locking positions and oblique to resiliently deforming directions DD of the lock 13.

A retainer accommodating space 16 is formed in the housing 10 above the cavities 12 and the locks 13 and is open in the left and front surfaces of the housing 10. A deformation permitting space 17 is defined in the retainer accommodating space 16 above each lock 13 and permits the lock 13 to deform resiliently out of an insertion path of the terminal fitting 30 at an intermediate stage of inserting the terminal fitting 30. Further, a transverse guide rib 18 is formed at a rear end of the ceiling surface of the retainer accommodating space 16, and a locking step 19 and a locking projection 20 are formed at a front end of the ceiling surface.

Each female terminal fitting 10 is narrow and long in forward and backward directions. A substantially rectangular tube 11 is formed at a front part of the terminal fitting 10 and a wire connecting portion 32 is at a rear part. The wire connecting portion can be crimped into connection with a wire 36. The rectangular tube 31 opens forward and has an internally disposed resilient contact piece (not shown) to be connected with a tab (not shown) of a male terminal fitting of a mating connector (not shown). A first engaging portion 33 is formed on the upper wall of the rectangular tube 31 by embossing a portion of the upper wall to have a substantially semicircular shape when viewed from the front. The first engaging portion 33 is engageable with the corresponding lock 13. A second securing portion 34 is at the rear edge of the upper wall of the rectangular tube 31 and is engageable with the retainer 40. A slanted guide surface 35 is formed at a left end (bottom end in FIGS. 4, 5, 19 to 22) of the second securing portion 34 and is oblique both to inserting and withdrawing directions ID of the terminal fitting 30 into and from the housing and to a mounting direction MD of the retainer 40 into the housing 10.

The retainer 40 has a substantially plate-shaped main body 41 that is insertable into the retainer accommodating space 16 and the deformation permitting spaces 17, a substantially rectangular mating side wall 42 that extends down from the front edge of the main body 41, and a left wall 43 that extends down from the left edge of the main body 41.

The retainer 40 can be fit into the retainer accommodating space 16 from the left side of the housing 10 and is transversely displaceable between a partial locking position (see FIGS. 2, 4, 13, 14, 19 and 20) and a full locking position (see FIGS. 3, 5, 15 and 22). A guide groove 44 at the rear end of the upper surface of the main body 41 engages the guide rib 18 of the housing 10 to guide movement of the retainer 40 in the moving direction MD and to prevent loose movements in forward and backward directions substantially normal to the moving direction MD. Thus, the front wall 42 is brought substantially into sliding contact with an opening edge in the front end surface of the housing 10, thereby preventing the retainer 40 from making loose vertical movements.

With the retainer 40 at the partial locking position, a first locking projection 45 and a second locking projection 46 at the front end of the upper surface of the retainer main body 41 engage the left surface of the locking projection 20 and the locking step 19 in the housing 10. Thus, the retainer 40 is prevented from making loose transverse movements along the moving direction MD with respect to the housing 10. With the retainer 40 displaced to the full locking position, the first locking projection 45 engages the right surface of the locking projection 20, and the right edge of the front wall 42 engages the left surface of a loose movement preventing portion 21 of the housing 10. Thus, the retainer 40 is prevented from making loose transverse movements.

The retainer main body 41 has escaping spaces 47 arranged substantially along the moving directions MD of the retainer 40. The escaping spaces 47 are through holes that penetrate the retainer main body 41 vertically and permit the locks 13 to deflect up (direction DD) by overlapping the deformation permitting spaces 17 when the retainer 40 is at the partial locking position. Beams between adjacent escaping spaces 17 in the retainer main body 41 serve as first securing portions 48. The beams 48 are narrow and long in forward and backward directions of the housing 10 and have both front and rear ends thereof supported on the retainer main body 41. The first securing portions 48 are retracted leftward and away from the deformation permitting spaces 17 when the retainer 40 is at the partial locking position so that the locks 13 can deform into the deformation permitting spaces 17. However, the first securing portions 48 enter the deformation permitting spaces 17 and contact the locks 13 from above when the retainer 40 is at the full locking position to prevent deformation of the locks 13 into the deformation permitting spaces 17. The right ends of the bottom surfaces of the first securing portions 48 are slanted to form slanted guide surfaces 49 (see FIGS. 13 to 18). The slanted guide surfaces 49 of the retainer 40 incline oblique to the moving directions MD of the retainer 40 between the partial locking position and the full locking position and oblique to the resiliently deforming directions DD of the locks 13, similar to the slanted guide surfaces 15 of the locking portions 13.

The bottom surface of the retainer main body 41 has step-shaped second securing portions 50 that are retracted leftward from the cavities 12 when the retainer 40 is at the partial locking position, and enter the cavities 12 to engage the second engaging portions 34 of the terminal fittings 30 from behind when the retainer 40 is at the full locking position. A slanted guide surface 51 is formed at the right end of the front surface of each second securing portion 50 and extends oblique both to the moving directions MD of the retainer 40 between the partial and full locking positions and to the inserting and withdrawing directions ID of the terminal fitting 30 (see FIGS. 19 to 22).

The front wall 42 engages the front end surfaces of the terminal fittings 30 from the front exactly in the opposite way of the second securing portions 50. Thus, the terminal fittings 30 contact the front wall 42 from behind when the terminal fittings 30 reach their proper insertion positions, and further forward movement of the terminal fittings 30 is prevented. A distance along forward and backward directions between the rear surface of the front wall 42 and the second securing portion 50 equals or slightly exceeds a distance between the front end surfaces of the terminal fittings 30 and rear engaging surfaces of the second engaging portions 34. The front wall 42 is at the front ends of the insertion paths of the terminal fittings 30 regardless of which position the retainer 40 is located at within its movable range between the partial locking position and the full locking position. Thus the terminal fittings 30 never fail to come into contact the front wall 42. Further, the rear surface of the front wall 42 is a substantially flat surface parallel with the moving directions of the retainer 40 between the partial locking position and the full locking position.

The front wall 42 has substantially rectangular tab holes 52 that are retracted leftward from the terminal fittings 30 in the housing 10 when the retainer 40 is at the partial locking position, but substantially face the terminal fittings 30 in the housing 10 when the retainer 40 is at the full locking position. The front wall 42 also has substantially rectangular jig insertion holes 53 that substantially face the locks 13 with respect to the transverse direction when the retainer 40 is at the partial locking position, but are retracted rightward from the locks 13 when the retainer 40 is at the full locking position.

The connector is assembled as follows. First, the retainer 40 is mounted at the partial locking position in the housing 10 such that the second securing portions 50 of the retainer 40 are retracted to the left of the insertion paths of the terminal fittings 30. Thus, the terminal fittings 30 can be inserted into the cavities 12. Further, the first securing portions 48 of the retainer 40 are retracted leftward from the locks 13 and the escaping spaces 47 are above the locks 13 while overlapping the deformation permitting spaces 17. Thus, upward resilient deformation of the locks 13 away from the insertion paths and into the deformation permitting spaces 17 is permitted.

The terminal fittings 30 are inserted into the corresponding cavities 12 in this state. The locks 13 interfere with the first engaging portion 33 on the upper wall of the rectangular tube 31 at an intermediate stage of the insertion locks 13. As a result, the locks 13 deform up in the deflection direction DD and enter the deformation permitting space 17 and the escaping space 33. The terminal fitting 30 eventually reaches its proper insertion position where the front end surface thereof abuts against the front wall 42 of the retainer 40. The lock 13 then resiliently restores and engages the first engaging portion 33 from behind, with the result that the terminal fitting 30 is locked by the lock 13.

The retainer 40 then is pushed from the partial locking position to the full locking position so that the second securing portions 50 of the retainer 40 engage the second engaging portions 34 of the terminal fittings 30 from behind. Thus, the retainer 40 locks the terminal fittings 30. As the retainer 40 is moved to the full locking position, the first securing portions 48 of the retainer 40 enter the deformation permitting spaces 17 to engage the locks 13 from above. As a result, the retainer 40 prevents the locks 13 from being displaced upward. In this way, the retainer 40 locks the terminal fittings 30 via the locks 13, and the terminal fittings 30 are locked triply and are prevented from coming out.

With the retainer 40 moved to the full locking position, the tab holes 52 of the front wall 42 face the terminal fittings 30 in the housing 10. When the connector is connected with the mating connector (not shown), the tabs (not shown) of the mating terminals enter the rectangular tubes 31 through the tab holes 52 to be connected with the terminal fittings 30.

The terminal fitting 30 can be withdrawn from the housing 10 by first moving the retainer 40 from the full locking position to the partial locking position. Thus, the locks 13 face the escaping spaces 47 and deformation is permitted. Additionally, the second securing portions 50 are retracted from the moving paths of the terminal fittings 30, and the jig insertion holes 53 face the locks 13. The lock 13 is lifted up by a narrow jig (not shown) inserted into the jig insertion hole 53 and disengaged from the first engaging portion 33 of the terminal fitting 30. The wire 36 or part of the terminal fitting 30 then is gripped to pull the terminal fitting 30 backward while this state is maintained.

In the connector of this embodiment, when the terminal fitting 30 substantially is inserted properly, the first securing portion 48 enters the deformation permitting space 17 to prevent the lock 13 from being resiliently deformed in the direction DD and away from the terminal fitting 30, and the second securing portion 50 directly engages the terminal fitting 30. Thus, the first securing portion 48 and the second securing portion 50 lock the terminal fitting 30 securely. When the terminal fitting 30 is left insufficiently inserted, the first securing portion 48 of the retainer 40 interferes along the moving direction MD with the lock 13 that remains resiliently deformed and in the deformation permitting space 17 due to the interference with the first engaging portion 33. Additionally, the second securing portion 50 interferes along the moving direction MD with the rectangular tube 31 of the terminal fitting 30. This hinders movement of the mounting the retainer 40 into the housing 10, and the insufficiently inserted state of the terminal fitting 30 can be detected. The retainer 40 is provided with the first securing portions 48 and the second securing portions 50. Thus, even if either one of the locking portions is made smaller to make the connector smaller, the terminal fittings 30 can be locked securely and the insufficient insertion of the terminal fittings 30 can be detected.

Further, the arranging direction (vertical direction) of the terminal fittings 30, the locks 13 engageable with the terminal fittings 30, and the deformation permitting spaces 17 into which the locks 13 enter upon resilient deformation is substantially normal to the arranging direction of the terminal fittings 30, i.e. transverse direction, the deformation permitting spaces 17 are not narrowed even if the arrangement intervals of the terminal fittings 30 are narrowed and it is not necessary to thin the first securing portions 48 of the retainer 40 which are to be inserted into the deformation permitting spaces 17. Therefore, there is no possibility of reducing the locking function of the first securing portions 48 and the insufficient insertion detecting function due to the reduced arrangement intervals of the terminal fittings 30.

Furthermore, the mounting direction MD of the retainer 40 into the housing 10 is parallel with the arranging direction of the terminal fittings 30. Thus, the terminal fittings 30 may be arrayed at several stages with a plurality of terminal fittings 30 arranged substantially side by side at each stage.

The retainer 40 mounted in the housing 10 is movable along the moving direction MD between the partial locking position, where the insertion of the terminal fittings 30 is permitted, and the full locking position, where the terminal fittings 30 are locked. Thus, the retainer 40 can be mounted beforehand at the partial locking position when the housing 10 and the retainer 10 are shipped to a location where the terminal fittings 30 are inserted. Therefore, parts management at the time of shipment can be simplified.

The second securing portions 50 of the retainer 40 engage and lock the terminal fittings 30 from behind and the front wall 42 holds the terminal fitting 30 at the front-limit positions. Thus, between the front wall 42 and the second securing portions 50 does not vary even if the retainer 40 shakes with respect to the housing 10. This prevents the terminal fittings 30 from making loose movements in the inserting and withdrawing directions ID with respect to the retainer 40.

The front wall 42 is formed such that the terminal fittings 30 contact the front wall 42 regardless of which position the retainer 40 is at between the partial locking position and the full locking position. Additionally, the rear surface of the front wall 42 is a substantially flat surface parallel with the moving directions of the retainer 40 between the partial locking position and the full locking position. Thus, the front wall 42 and the terminal fittings 30 already held in contact with the front wall 42 are moved relatively in sliding contact with each other when the retainer 40 is moved form the partial locking position to the full locking position. Therefore, the front wall 42 and the terminal fittings 30 do not get caught as the retainer 40 is moved.

Both the second securing portions 50 of the retainer 40 and the second engaging portions 34 of the terminal fittings 30 are formed with the slanted guide surfaces 35, 51 that are oblique to the moving directions MD of the retainer 40 from the partial locking position to the full locking position. Thus, even if the terminal fittings 30 are displaced back toward the terminal insertion side from the proper insertion positions where they contact the front wall 42 (see FIG. 20) during the movement of the retainer 40 from the partial locking position to the full locking position, the terminal fittings 30 are pushed forward by the inclinations of the slanted guide surfaces 35, 51 held in contact with each other (see FIG. 21) to reach the specified insertion-limit positions where they contact the front wall 42 (see FIG. 22). In other words, the retainer 40 and the terminal fittings 30 do not get caught by each other while the retainer 40 is pushed to the full locking position.

Figure 17:
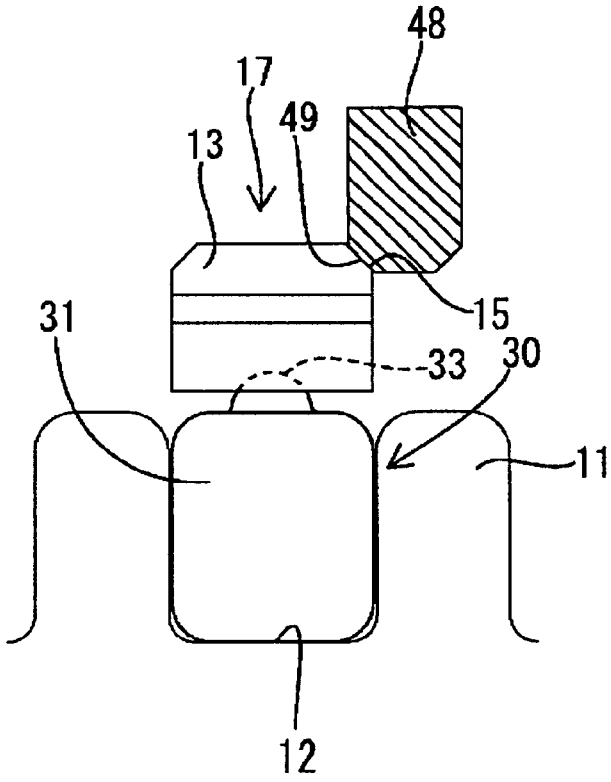
FIG. 17 is a horizontal section showing a positional relationship between the lock and the first securing portion in a state where the retainer is displaced toward the full locking position and slanted guide surfaces are held in contact with each other during the resilient deformation of the lock.
Figure 18:
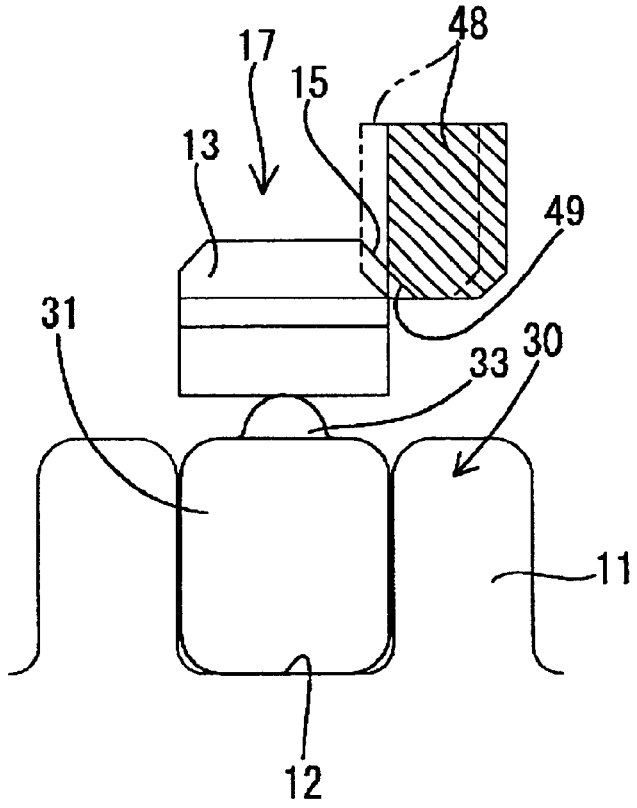
FIG. 18 a horizontal section showing a positional relationship between the lock and the first securing portion in a state where the retainer is displaced toward the full locking position and the lock pushes the first securing portion toward the partial locking position by the inclinations of the slanted guide surfaces during the resilient deformation of the lock.
Figure 19:
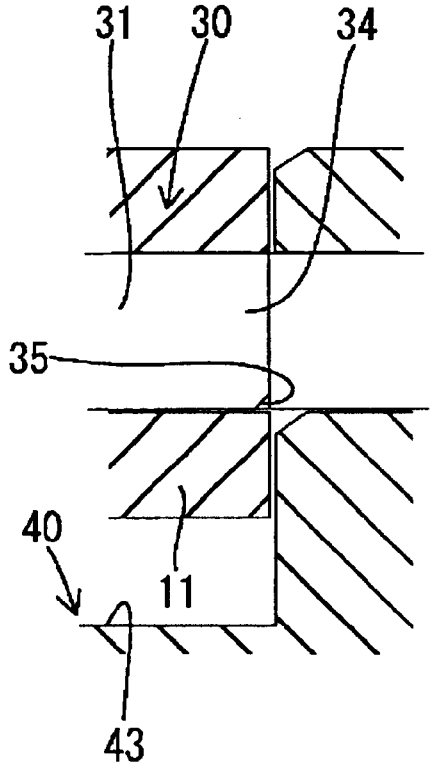
FIG. 19 is a fragmentary enlarged horizontal section showing a state where the terminal fitting is properly inserted and the retainer is located at the partial locking position.
Figure 20:
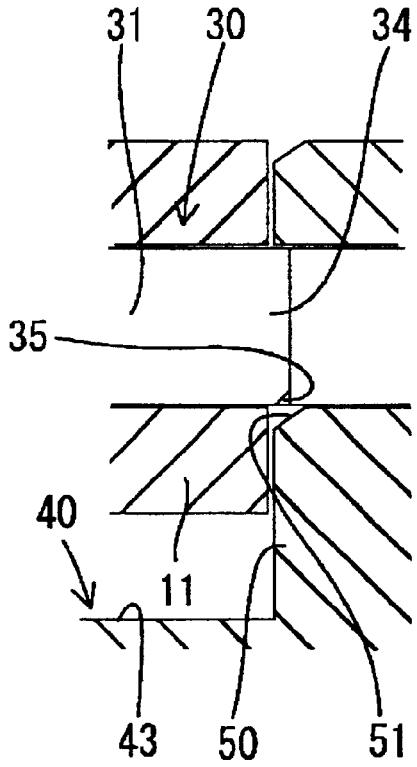
FIG. 20 is a fragmentary enlarged horizontal section showing a insufficiently inserted state of the terminal fitting.
Figure 21:
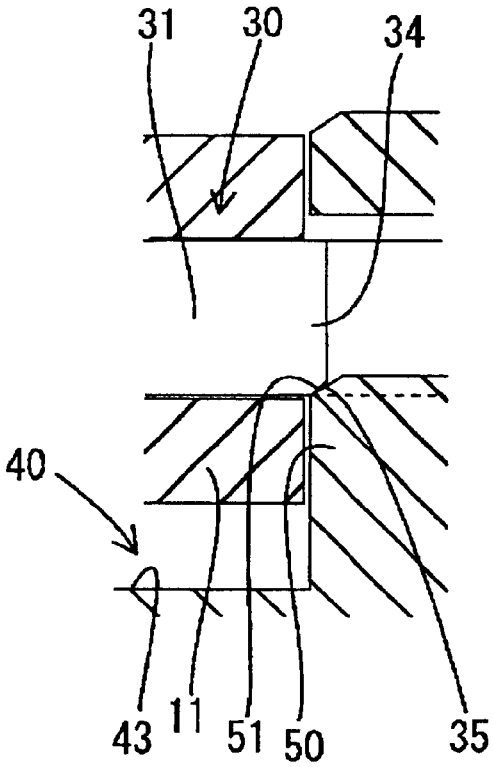
FIG. 21 is a fragmentary enlarged horizontal section showing a state where a slanted guide surface of the retainer contacts a slanted guide surface of the terminal fitting insufficiently inserted during the movement of the retainer from the partial locking position to the full locking position.
Figure 22:
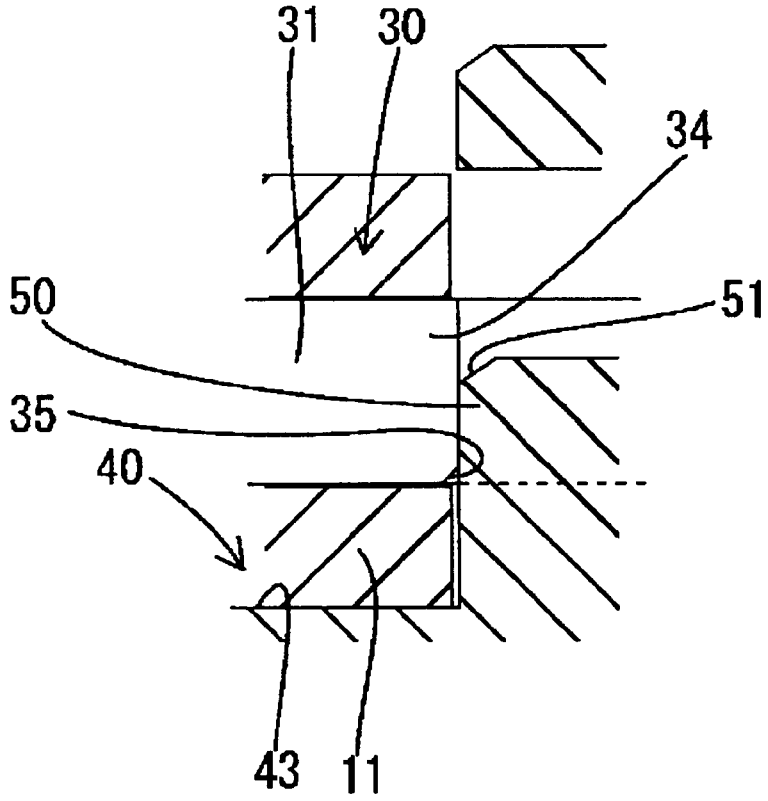
FIG. 22 is a fragmentary enlarged horizontal section showing a state where the retainer pushes the insufficiently inserted terminal fitting to its proper insertion position by the inclinations of the slanted guide surfaces and is moved to the full locking position.

Both the locks 13 and the first securing portions 48 are formed with the slanted guide surfaces 15, 49 that extend oblique both to the resiliently deforming directions DD (vertical direction) of the locks 13 and to the moving directions MD (transverse direction) of the retainer 40 between the partial and full locking positions. Accordingly, with the retainer 40 displaced toward the full locking position, if portions of the first securing portions 48 enter the deformation permitting spaces 17 above the locks 13 (shown by solid line in FIG. 16), the slanted guide surfaces 15 of the locks 13 contact the slanted guide surfaces 49 of the first securing portions 48, as shown in FIG. 17, to deform the locks 13 up by the interference with the terminal fittings 30.

The first securing portions 48 of the retainer 40 then are pushed from positions (shown by chain line in FIG. 18) partly above the locks 13 to proper partial locking positions (shown by solid line in FIG. 18) transverse from the locks 13 by the inclinations of the slanted guide surfaces 15, 49 as the locks 13 are moved up. In other words, the locks 13 are resiliently deformable into the deformation permitting spaces 17 while being held in sliding contact with the first securing portions 48 via the slanted guide surfaces 15, 49. As a result, the terminal fittings 30 can be inserted without any problem.

The main body 41 of the retainer 40 has escaping spaces 47 for permitting the resilient deformation of the locks 13. The escaping spaces 17 are located to overlap the deformation permitting spaces 17 when the retainer 40 is at the partial locking position. Thus, parts of the escaping space 47 and of the deformation permitting spaces 17 are at a substantially same longitudinal position when seen in the longitudinal direction of the housing 10. The escaping spaces 47 are through holes that penetrate the retainer main body 41. Thus, the retainer main body 41 can be thinner as compared to a case where the escaping spaces 47 are in the form of recesses.

The escaping spaces 47 are through holes. Hence, the first securing portions 48 between adjacent escaping spaces can be in the form of beams that have the opposite ends supported on the retainer main body 41, ensuring sufficient strength for the first securing portions 48.

The present invention is not limited to the described and illustrated embodiment. For example, the following embodiments are also embraced by the technical scope of the present invention as defined by the claims. Beside the following embodiments, various changes can be made without departing from the scope and spirit of the present invention as defined by the claims.

The terminal fittings and the locks that engage the terminal fittings are arranged at an angle to the arranging direction of the terminal fittings. However, the invention also is applicable to cases where the terminal fittings and the locks that engage the terminal fittings are arranged substantially parallel with the arranging direction of the terminal fittings, i.e. the locks and the deformation permitting spaces are between adjacent terminal fittings.

The retainer is assembled with the housing by being moved straight in the direction MD substantially normal to the inserting direction of the terminal fittings in the foregoing embodiment. However, the retainer may be assembled to the housing from the front substantially parallel with the inserting direction ID of the terminal fittings to be located at the partial locking position. The retainer then may be moved in the direction MD substantially normal to the inserting direction ID of the terminal fittings between the partial and full locking positions.

The assembling direction MD of the retainer with the housing is substantially parallel with the arranging direction of the terminal fittings in the foregoing embodiment. However, the assembling direction of the retainer may be substantially normal both to the arranging direction of the terminal fittings and to the inserting direction ID of the terminal fittings.

Although the retainer assembled with the housing is movable between the partial locking position where the insertion of the terminal fittings is permitted and the full locking position where the retainer locks the terminal fittings in the foregoing embodiment, the retainer may not be movable between the partial locking position and the full locking position and may be assembled with the housing only at the full locking position where the retainer locks the terminal fittings.

What is claimed is:

1. A connector, comprising:

a housing (10) formed inside with at least one lock (13) and at least one corresponding deformation permitting space (17) for the lock (13), at least one terminal fitting (30) to be inserted into the housing (10), and a retainer (40) to be assembled with the housing (10), wherein the lock (13) is deformed resiliently into the deformation permitting space (17) and substantially retracted from an insertion path for the terminal fitting (30) during the insertion of the terminal fitting (30), when the terminal fitting (30) substantially reaches its proper insertion position, the lock (13) is restored resiliently and engages the terminal fitting (30) to prevent the terminal fitting (30) from coming out, and the retainer (40) comprises a first securing portion (48) for securing the terminal fitting (30) by entering the deformation permitting space (17) to prevent the resilient deformation of the lock (13) and a second securing portion (50) for securing the terminal fitting (30) by directly engaging the terminal fitting (30).

2. The connector of claim 1, wherein a plurality of the terminal fittings (30) are inserted substantially side by side, and an arranging direction of the terminal fittings (30), the locks (13), and the deformation permitting spaces (17) is arranged substantially normal to an arranging direction of the terminal fittings (30).

3. The connector of claim 2, wherein an assembling direction (MD) of the retainer (40) with the housing (10) is substantially parallel with the arranging direction of the terminal fittings (30).

4. The connector of claim 1, wherein the retainer (40) is movable between a first position (FIGS. 2, 4; 13; 14; 19; 20) where insertion of the terminal fitting (30) into the housing (10) is permitted by retracting the first securing portion (48) from the deformation permitting space (17) and retracting the second securing portion (50) from an insertion path for the terminal fitting (30), and a second position (FIGS. 3; 5; 15; 22) where the terminal fitting (30) is held so as not to come out by causing the first securing portion (48) to enter the deformation permitting space (17) and engaging the second securing portion (50) with the inserted terminal fitting (30).

5. The connector of claim 1, wherein the retainer (40) is formed unitarily with the second securing portion (50) and an insertion-stop portion (42) for holding the terminal fitting (30) at an insertion-limit position thereof by engaging the terminal fitting (30) from a side substantially opposite the second securing portion (50).

6. The connector of claim 5, wherein the terminal fitting (30) is insertable into the housing (10) from behind, and wherein the insertion-stop portion (42) is a front-stop (42) with which the terminal fitting (30) comes in to contact from behind.

7. The connector of claim 5, wherein the insertion-stop portion (42) is held substantially in sliding contact when the retainer is moved along an assembling direction (MD).

8. The connector of claim 1, wherein at least one of the second securing portion (50) of the retainer (40) and at least one engaging portion (34) of the terminal fitting (30) is formed with a slanted guide surface (51; 35) oblique to an assembling direction (MD) of the retainer (40), so that if the terminal fitting (30) is displaced from a proper insertion position (FIG. 20) during the movement of the retainer (40) the terminal fitting (30) is pushed toward the proper insertion position by the inclination of the slanted guide surface (51; 35).

9. The connector of claim 1, wherein at least one of the deformation preventing portion (48) and the lock (13) is formed with slanted guides (49; 15) oblique to resiliently deforming directions (DD) of the locks (13) and moving directions (MD) of the retainer (40) between the first and second positions.

10. A connector, comprising:

a housing (10) formed inside with resiliently deformable locks (13) and corresponding deformation permitting spaces (17) for accommodating deformation of the locks (13);

terminal fittings (30) being insertable into the housing (10) and being configured to deform the respective locks (13) resiliently into the deformation permitting space (17) during the insertion, the terminal fittings (30) further being configured to permit the respective locks (30) to be restored resiliently and engage the respective terminal fittings (30) when the terminal fittings (30) reach proper insertion positions; and a retainer (40) to be assembled with the housing (10), the retainer (40) comprises first securing portions (48) for securing the terminal fittings (30) by entering the deformation permitting spaces (17) to prevent the resilient deformation of the locks (13) and second securing portions (50) for directly engaging and securing the terminal fittings (30).

11. The connector of claim 10, wherein the retainer (40) is movable between a partial locking position (FIGS. 2; 4; 13; 14; 19; 20) where insertion of the terminal fittings (30) into the housing (10) is permitted by retracting the first securing portions (48) from the deformation permitting spaces (17) and retracting the second securing portions (50) from an insertion path for the terminal fittings (30), and a full locking position (FIGS. 3; 5; 15; 22) where the first securing portions (48) enter the deformation permitting spaces (17) to hold the locks (13) in engagement with the terminal fittings (30) and where the second securing portions (50) engage the inserted terminal fittings (30).

12. The connector of claim 11, wherein the retainer (40) is formed unitarily with the second securing portions (50) and an insertion-stop portion (42) for holding the terminal fittings (30) at an insertion-limit position thereof by engaging the terminal fittings (30) from a side substantially opposite the second securing portions (50).

13. The connector of claim 12, wherein the terminal fittings (30) are insertable into the housing (10) from behind, and wherein the insertion-stop portion (42) is a front-stop (42) with which the terminal fittings (30) come in to contact from behind.

* * * * *